United States Patent [19]

Helmer et al.

[11] Patent Number: 4,743,303

[45] Date of Patent: May 10, 1988

[54] AQUEOUS DISPERSIONS, A PROCESS FOR THEIR PREPARATION AND THE USE OF THE DISPERSIONS AS SIZING AGENTS

[75] Inventors: Ulla Helmer, Solna; Randi Johansen, Bromma, both of Sweden

[73] Assignee: Casco Nobel AB, Stockholm, Sweden

[21] Appl. No.: 881,325

[22] Filed: Jul. 2, 1986

[51] Int. Cl.[4] ..... C08J 3/02; B32B 9/06

[52] U.S. Cl. ..... 106/236; 106/238; 162/158; 162/164.6; 428/498

[58] Field of Search ..... 106/236, 238, 218; 162/158, 162.3, 162.6

[56] References Cited

U.S. PATENT DOCUMENTS

| | | | |
|---|---|---|---|
| 2,386,033 | 10/1945 | Chappell | 106/144 |
| 3,139,373 | 6/1964 | Liggett | 162/180 |
| 3,940,519 | 2/1976 | Helmer et al. | 536/45 |
| 4,296,012 | 10/1981 | Okumichi | 106/287.24 |
| 4,522,686 | 6/1985 | Dumas | 106/218 |

OTHER PUBLICATIONS

Chem. Abst. 94:67567z Mar. 1979 Japan abstract, Hamada, #59:89357 May 23, 1984.

Sizing Seminar "An overview of cellulose reactive sizes" Dumas pp. 85–92, 1983 Tapp. series.

Sizing Seminar "Critical Phenomena in Rosin Sizing" Strazdins, E., pp. 53–65–Tapp. Seminar notes.

Abstract Bull. of the Inst. of Paper Chem. vol. 51 No. 10 Number 10271; Okumichi et al., Apr., 1981.

*Primary Examiner*—Theodore Morris

*Attorney, Agent, or Firm*—Fred Philpitt

[57] ABSTRACT

Aqueous cationic or anionic dispersions of rosin and certain synthetic sizing agents, carbamoyl chlorides, ketene dimers or acid anhydrides. The particles in the dispersed phase contain a mixture of rosin and synthetic sizing agent and the dispersions are prepared by homogenisation of a homogeneous mixture of the rosin material and the synthetic sizing agent in the presence of a dispersing agent. The dispersions are used as sizing agents in the production of paper, paper board, board and similar products.

26 Claims, No Drawings

AQUEOUS DISPERSIONS, A PROCESS FOR THEIR PREPARATION AND THE USE OF THE DISPERSIONS AS SIZING AGENTS

The present invention relates to aqueous dispersions of rosin and certain synthetic cellulose-reactive sizing agents. More particularly the invention relates to such dispersions, which may be anionic or cationic, wherein the particles of the dispersed phase contain a mixture of the rosin and the synthetic sizing agent. The invention also relates to a process for the preparation of the dispersions and to their use as hydrophobing agents in the production of paper, board and similar products.

One of the most essential properties of paper, paperboard and similar products is the resistance to penetration by water and other liquids. The two main methods for conferring hydrophobic properties to paper products are internal sizing and surface sizing. Internal sizing gives a hydrophobic effect in the entire paper structure while the effect of surface sizing is more or less limited to the virtual surface structure and the two methods can be used in combination.

Internal sizing is the addition of suitable chemicals to the cellulose stock and these chemicals are either adsorbed on the cellulose or react with this. In internal sizing rosin, which is fixed to the cellulose by precipitation with alum, or synthetic sizing agents, such as alkyl ketene dimers, isocyanates, acid anhydrides and carbamoyl chlorides, which react with the cellulose, are mainly used.

Rosin was earlier mainly used in the form of so-called paste size but for some time now the development has gone towards the use of rosin in the form of aqueous dispersions of rosin with high free rosin content and with very small particle size. Such dispersions are prepared by means of differently charged emulsifiers, as disclosed for example in the U.S. Pat. No. 3,817,768 and the British Pat. No. 1,551,645.

Internal sizing with rosin certainly gives the finished paper product good resistance to penetration by water, but often it does not give sufficient resistance to penetration by acid liquids, such as lactic acid, which limits the usefulness of paper and board sized with rosin. As an internal size rosin also has certain drawbacks in the form of limitations with regard to the pH and the temperature of the stock. Rosin has a further disadvantage in that it must be used in comparatively high amounts to give a satisfactory sizing effect. Fortification of rosin, ie the reaction with an $\alpha$-$\beta$-unsaturated polybasic acid, or anhydride thereof, such as fumaric acid, maleic acid and itaconic acid or anhydrides thereof, increases the hydrophobing effect. Increased degree of fortification does, however, result in an increase in the softening point and in the viscosity of the melted rosin phase and this means that very high temperatures are required at the preparation of such rosin dispersions, which is undesirable both from an economical and a technical point of view. A too high softening point for the rosin material also gives an impaired sizing effect and fortification of rosin in order to increase the sizing effect can thus not be carried too far.

However, despite their several disadvantages, as stated above, rosin dispersions are very widely used and cannot in all circumstances be replaced by synthetic sizing agents. In contrast to synthetic sizing agents, rosin does for example give a good adhesion to yankee cylinders and rosin dispersion can thus be used in paper production wherein such cylinders are utilized.

Synthetic sizing agents, such as ketene dimers, acid anhydrides, isocyanates and carbamoyl chlorides, react with the cellulose and give an irreversible bond. These sizing agents generally give a very good sizing effect, both to water and other liquids, at small added amounts. They are efficient over a wide pH range and also at a high pH. One disadvantage of the synthetic sizing agents is that they are considerably more expensive than rosin, although this might in several cases be balanced by the higher degree of efficiency at lower amounts. Synthetic sizing agents are added to the stock in the form of charged dispersions and due to the reactivity of the chemicals there is a risk of hydrolysis in water and this leads to problems both to obtain storage stable dispersions and to avoid decreased activity of the dispersions.

It is known to combine rosin and synthetic sizing agents, ketene dimers, acid anhydrides and isocyanates, in order to obtain a more widely useful sizing agent. Cationic dispersions containing rosin and the mentioned synthetic sizing agents are disclosed in the European patent application No. 74544. These dispersions contain as the dispersed phase as well particles of rosin as particles of the synthetic sizing agent. The processes for sizing disclosed in the European patent application also includes a separate addition to the stock of a cationic rosin dispersion and of a cationic dispersion of the synthetic sizing agent.

According to the present invention it has been found that rosin and certain synthetic sizing agents can be combined in aqueous dispersions to products which are not only useful in a very wide field as concerns production of paper products and in which the properties of the respective agents are made use of and increased in a very advantageous manner, but which also give other essential advantages. The combination of rosin and synthetic sizing agent according to the present invention are aqueous dispersions wherein the particles of the dispersed phase are made up from a mixture of the rosin material and the synthetic sizing agent. Hereby a decrease in the softening point of the rosin is obtained and this in turn results in a better spreading on the fibres and thus an improved sizing. This decrease in softening point of the rosin and thus in the viscosity of the dispersed phase means that the dispersions can be prepared at substantially lower temperatures which is of economic importance since costs for heating and plant wear are considerably reduced. With regard to the rosin in the "mixed particles" in the present dispersions it should also be mentioned that the mixing of this with synthetic sizing agent leads to a decreased risk of crystallization, and thus to a decreased need of formaldehyde which is normally used in order to lower the crystalization of rosin.

As the particles in the present dispersions are made up from a homogeneous mixture of the two materials the synthetic sizing agent will to a considerable extent be protected by the rosin material and the synthetic agent in the dispersions will thus get a considerably reduced tendency to hydrolysis. Fortified rosin generally has a density greater than 1.05 g/cm$^3$ and the density depends, among other things, on degree of fortification and impurities. By extending with the synthetic sizing agent, which in itself has a lower density, of from about 0.9 to about 0.95 g/cm$^3$, the particles in the dispersions will have a density below the density of the rosin material in these. This lowering in density gives a reduced risk of sedimentation in the dispersions and very stable dispersions can be obtained with "mixed particles" according to the invention.

With regard to the advantages obtained from the actual combination of two different types of sizing agents it should be particularly mentioned that a smaller amount of synthetic sizing agent in the particles of the sizing dispersions give a surprising improvement in the resistance to lactic acid of produced paper. When the combinations contain smaller amounts of rosin and mainly synthetic sizing agent a product is obtained which has a certain adhesion to yankee cylinders and further a better distribution of the synthetic sizing agent over the fibres is obtained.

The present invention thus relates to anionic or cationic aqueous dispersions wherein the dispersed phase consists of particles which contain a mixture of rosin material and a synthetic sizing agent which is a hydrophobing carbamoyl chloride, ketene dimer or acid anhydride, whereby the mixture contains from 10 to 96 percent weight of rosin material.

The active material in the dispersions of the invention can thus comprise either mainly rosin material or mainly synthetic sizing agent and the dispersions contain either at least one anionic dispersing agent or, alternatively, at least one cationic dispersing agent.

The rosin material used in the dispersions according to the present invention should have a high free rosin content, ie a high acid number of about 200 and higher, low content of anhydride derivatives, and not be saponified or esterified to any essential extent. Rosin and rosin material herein otherwise refer to known types of rosin such as gum-, wood- and tall oil rosin. The rosin can be crude, refined, proportioned, hydrated or otherwise modified before it is fortified in a known manner. The fortified rosin can also be treated with for example formaldehyde or iodine to avoid crystallization. As stated earlier the present mixing of the rosin material means that the need of chemicals to decrease crystallization can be reduced and this is particularly advantageous with regard to the most often used such chemical, ie formaldehye. The rosin material is preferably fortified rosin, ie rosin reacted with an $\alpha$-$\beta$-unsaturated polybasic acid or its anhydride, eg fumaric acid, maleic acid, itaconic acid or their anhydrides. Fortified tall oil rosin is particularly suitable. Fortified rosins generally contain from about 5 to about 10 percent by weight of adducted acid or anhydride, based on the total weight of the fortified rosin. In combinations according to the present invention such conventionally fortified rosins can be used but also, without any disadvantages, rosin material having higher degree of fortification, up to about 15 percent.

The synthetic sizing agent in the mixed particles in the present dispersions are hydrophobing carbamoyl chlorides, ketene dimers or acid anhydrides, These compounds are per se well-known cellulose-reactive sizing agents. Hydrophobing carbamoyl chlorides, which are disclosed for example in the U.S. Pat. No. 3,887,427 have the formula

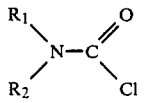

wherein $R_1$ is an organic, hydrophobic group having from about 8 to about 40 carbon atoms and wherein $R_2$ is also such a group or a lower alkyl group. Suitably both $R_1$ and $R_2$ in the carbamoyl chlorides are organic hydrophobic groups, particularly alkyl groups having from about 12 to about 30 carbon atoms.

Keten dimers have the formula

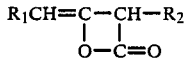

wherein $R_1$ and $R_2$ are organic hydrophobic groups, usually alkyl groups.

Acid anhydrides can be characterized by the general formula

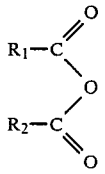

wherein $R_1$ and $R_2$ are organic, hydrophobic groups, and usually different such groups. It is possible, per se, to produce dispersions with mixed particles containing organic isocyanates as the synthetic sizing agent. It has, however, been found that admixing of these synthetic sizing agents in smaller amounts do not give any substantial influence on either the softening point or the density of the rosin.

According to the present invention it is preferred that the synthetic sizing agent in the mixed particles of the dispersions is a carbamoyl chloride. Carbamoyl chlorides give very good influence on the softening point, density and viscosity. Further, dispersions of mixed particles containing carbamoyl chlorides are not sensitive to alum and they are efficient over wide pH ranges and at the same time they give very good resistance to lactic acid.

In the dispersions of the present invention the dispersed phase consists of particles of a mixture of rosin and synthetic sizing agent, whereby the mixture contains from 10 to 96 percent by weight of rosin. As the particles contain a homogeneous mixtures of the two active sizing agents the weight ratio in each particle in the dispersion will thus be in this range. The particles in the dispersions according to the invention consists essentially of the combination of the two active hydrophobing agents. Minor amounts of non-hydrophobing substances may of course be present, eg production auxiliary substances such as hydrocarbons. The amount of such substances should, however, preferably not exceed 15 percent by weight based on the combination of the active hydrophobing agents.

The dispersions according to the invention can be anionic or cationic. It is preferred that the dispersions are cationic when they contain lower amounts of rosin, while dispersions with higher amounts of rosin can be anionic or cationic. For dispersions with higher amounts of rosin the mixture suitably contains between 96 and 80 and preferably between 96 and 90 percent by weight of rosin. For dispersions with lower amounts of rosin and higher amounts of synthetic sizing agent the mixture suitably contains from 10 to 60 and preferably from 20 to 40 percent by weight of rosin. The first mentioned kind of dispersion, ie with predominantly rosin, is particularly preferred as hereby the earlier stated advantages with decrease in the softening point of the rosin etc are especially pronounced. Synthetic sizing agents do in themselves give good resistance to lactic acid for paper and board sized therewith. It has been found that a surprising increase in lactic acid resistance can be obtained with dispersions according to the present invention which contain small amounts of synthetic sizing agent, and which then can be considered as dispersions of modified rosin.

Carbamoyl chlorides are the preferred synthetic sizing agents in the present dispersions. In contrast to ketene dimers, carbamoyl chlorides are not sensitive to alum and thus give a better effect in combinations with higher amounts of rosin, which require alum and low pH for retention to the cellulose and good effect.

The dispersions according to the invention contain finely divided particles of a mixture of rosin and synthetic sizing agent as above and one or several anionic or cationic dispersing agents. The dry content, the total amount of hydrophobing agent, of the dispersions should be within the range from 10 to 50 percent by weight and suitably within the range from 30 to 40 percent by weight at higher amounts of rosin, and suitably within the range of from 15 to 20 percent by weight at higher amounts of synthetic sizing agents.

The dispersions of the invention also contain one or more dispersing agents from the groups anionic and cationic dispersing agents. The amount of dispersing agent should be sufficient to give the dispersion the desired charge and storage stability and it should normally be at least 2 percent by weight, based on the amount of sizing agent. The upper limit is not critical. However, generally there are no reasons for utilizing more than 5 percent by weight.

The requirements on the dispersing agents are that they give the desired net charge and that they do not have a negative influence on the hydrophobing effect of the dispersions. Anionic dispersing agents may for example be selected from alkyl sulphates, alkyl sulphonates, alkylarene sulphonates etc. Particularly suitable anionic dispersing agents are alkyl sulphates and alkyl sulphonates, eg sodium lauryl sulphate. Cationic dispersing agents can for example be selected from nitrogen containing dispersing agents such as quaternary ammonium compounds and salts of tertiary amines. Particularly suitable cationic dispersing agents are quaternary ammonium compounds. The dispersions can also contain protective colloids such as cationic starch and cellulose derivatives. To obtain a more stable dispersion it can also be advantageous to include nonionic surface active agents in the dispersions.

The dispersions according to the present invention are prepared in per se conventional manner using the technique normally used at the preparation of dispersions of rosin in the form of dispersions with high free rosin content, ie by homogenizing the active substance in water, in the presence of dispersing agent, using high shear forces, high pressure and high temperatures to give fine particles, generally with a size below about 0.1 μm as the dispersed phase. The active substance which is homogenized according to the invention is a homogeneous mixture of rosin and synthetic sizing agent. The homogeneous mixture is preferably prepared by intensive mixing of melted rosin to which the synthetic sizing agent is added. The synthetic sizing agent can be added in solid form to the rosin and melt at the contact with the rosin. It is however, also possible to obtain a homogeneous mixture starting from solutions of the respective materials in solvents. The mixing of the rosin and the synthetic sizing agent is carried out under satisfactory agitation and can for example be carried out using a static mixer or an Ultra Turrax equipment. The warm mixture is then homogenized. The process should preferably be carried out continuously and with as short times as possible at elevated temperatures. The obtained dispersion is cooled.

As a homogeneous mixture of rosin and synthetic sizing agent is homogenized according to the present invention this means that the total solid substance has a lower softening point than rosin solely, and consequently that it is possible to utilize substantially lower temperatures and pressures at the homogenizing compared with what is used at the production of conventional rosin dispersions. This is advantageous not only with regard to decreased need for heating and reduced plant wear but also with regard to the stability in the systems. At the preparation of dispersions according to the invention the temperature at the homogenization can suitably be kept below 100° C., and the homogenization can be carried out at normal pressure.

The present invention thus also relates to a process for the production of an anionic or cationic aqueous dispersion containing a mixture of rosin and synthetic sizing agent, whereby a homogeneous mixture containing from 10 to 96 percent by weight of rosin and from 4 to 90 percent by weight of synthetic sizing agent is prepared, which mixture is then dispersed in water in the presence of at least one anionic or cationic dispersing agent to form a dispersion whereby the dispersed phase consists of particles of the homogeneous mixture of rosin and synthetic sizing agent.

The mixing of the phases, the dispersing etc can be carried out as described above and using the above described anionic or cationic dispersing agents. The particles in the obtained dispersion will consist of a mixture of the two active sizing agents in essentially the proportions in which the phases have been mixed. The particles will further have a density which is below the density of the used fortified rosin material. The dry content, the content of rosin and synthetic sizing agent, in the dispersions will suitably be within the range of from 10 to 50 percent by weight at higher rosin contents and suitably within the range of from 15 to 20 percent by weight at higher contents of synthetic sizing agent.

The obtained dispersions have very good stability as the particles in the dispersed phase all have the same density and as the synthetic sizing agent to a considerable extent will be protected by the rosin material and thus get a reduced tendency to hydrolysis.

The present dispersions are particularly suitable for sizing of paper, board, paper board and similar cellulose fibre products and this use forms part of the present invention. The dispersions can be used for internal sizing and surface sizing. The dispersions are preferably used for internal sizing and are then added to a cellulose stock in a conventional manner and chemicals conventionally used at paper production such as retention agents, fillers, alum, wet strength resins etc can of course be used with the present dispersions. In the actual dispersions paper chemicals, such as retention agents, can also be incorporated if so desired. The dispersions are suitably used in amounts corresponding to from 0.05 to 1 percent by weight of sizing agent, based on the cellulose fibres. Dispersions with the preferred synthetic sizing agent, carbamoyl chloride, do not give rise to any problems when alum is used in the systems and the sizing can be carried out over a wide pH range and a wide temperature range.

As the combined hydrophobing agent has a low softening point, compared with soleley rosin material as hydrophobing agent, a good spreading on the fibres and thus a good sizing effect is obtained. Otherwise, the advantages of the respective sizing agents are made use of, while their disadvantages are suppressed. Particularly advantageous is the good lactic resistance which is obtained at sizing using dispersions according to the invention which contain only minor aounts of synthetic hydrophobing agent. This type of dispersion is also particularly advantageous with regard to the cost-efficiency relationship.

The invention is further illustrated in the following examples which, however, are not intended to limit the same. Parts and percent relate to parts by weight and percent by weight respectively, unless otherwise stated.

EXAMPLE 1

A series of mixtures with varying contents of tall oil rosin fortified with fumaric acid (degree of fortification 10%) and distearyl carbamoyl chloride were prepared according to the following: The rosin was heated to about 150° C. and the carbamoyl chloride in solid form was then added and the heat supply shut off. The carbamoyl chloride melted at the incorporation and the mixture was homogenized at satisfactory agitation and then cooled to room temperature. Samples of the mixtures were taken and for these the softening point and density were determined. The results are shown in the table below.

| Mixture | Rosin parts | Carbamoyl chloride parts | Softening point | Density g/cm$^3$ |
|---|---|---|---|---|
| 1A | 100 | 0 | 100 | 1.10 |
| 1B | 90 | 10 | 82 | 1.07 |
| 1C | 80 | 20 | 78 | 1.05 |
| 1D | 70 | 30 | 60 | 1.03 |
| 1E | 60 | 40 | 52 | 1.02 |
| 1F | 50 | 50 | 45 | 1.00 |
| 1G | 30 | 70 | 40 | 0.97 |
| 1H | 0 | 100 | 42 | 0.92 |

EXAMPLE 2

Anionic dispersions of mixtures according to Example 1 were prepared in the following manner: 5 g of the mixture were dissolved in chloroform. 0.45 g of sodium lauryl sulphate were mixed with 245 g of water and the aqueous phase heated to 100° C. The chloroform phase was then added to the aqueous phase under intensive agitation using an Ultra Turrax homogenizer for 2 minutes without further heating. During the dispersion the solvent boiled off and the obtained dispersion was rapidly cooled on ice bath.

Dispersions were prepared according to the above from the mixtures 1A, 1B and 1C. The sizing effect of the dispersions was evaluated according to laboratory standard using paper sheets with a basis weight of 70 g/m$^2$ prepared from unbleached sulphate pulp at a pH of 4.5 in the presence of 2% alum. The sheets were prepared using equipment according to standard SCAN-C 23x. In the table below Cobb-values measured according to Tappi standard T 441 os-63 are shown. Cobb$_{60}$-values above 45 indicate poor sizing at basis weights of 70 g/m$^2$.

| | Cobb$_{60}$ g/m$^2$ Dispersion | | |
|---|---|---|---|
| Dosage | 2A | 2B | 2C |
| 0.13 | 65 | 50 | 45 |
| 0.17 | 42 | 28 | 25 |
| 0.23 | 32 | 24 | 22 |
| 0.32 | 25 | 20 | 19 |

The above given, and in the following examples given, dosage relate to added amount of sizing agent in %, calculated as dry on dry fibre weight.

EXAMPLE 3

Cationic dispersions of mixtures of Example 1 were prepared according to the following: 5 g of mixture were melted on a water bath to the respective temperatures: 55°, 50°, 45° and 47° C. 0.25 g of distearyl dimethylammonium chloride were dissolved in 245 g of water and warmed to the corresponding temperature. The aqueous phase and the molten mixture of sizing agents were homogenized under rapid agitation by means of an Ultra Turrax for 2 minutes. The dispersions were then rapidly cooled on an ice bath. In this manner dispersions were prepared from mixtures 1E, 1F, 1G and 1H and their effects were evaluated in the same manner as in Example 2.

| | Cobb$_{60}$ g/m$^2$ Dispersion | | | |
|---|---|---|---|---|
| Dosage % | 3E | 3F | 3G | 3H |
| 0.06 | 78 | 70 | 62 | 28 |
| 0.08 | 53 | 47 | 43 | 22 |
| 0.10 | 30 | 28 | 24 | 20 |
| 0.15 | 24 | 22 | 20 | 18 |
| 0.20 | 19 | 19 | 18 | 17 |

EXAMPLE 4

Paper sheets from Example 2 and 3 sized with the dispersions 2A, 2B, 2C, 3F and 3H were also evaluated with regard to their resistance to acid liquids using Hercules Sizing Tester. This instrument measures the reflection of a light ray against the underside of a paper on the surface of which ink of a pH of about 2.2 has been poured. When the reflection is lower than 80% of the original value the time in seconds is given. Values below 50 seconds indicate very poor sizing, values between 50 and 1000 indicate better and better sizing and values above 1000 very good sizing.

| | HST seconds for paper sized with | | | | |
|---|---|---|---|---|---|
| Dosage % | 2A | 2B | 2C | 3F | 3H |
| 0.13 | 4 | 130 | 170 | 370 | 1130 |
| 0.20 | — | — | — | 890 | 1480 |
| 0.23 | 330 | 630 | 790 | — | >2000 |
| 0.32 | 410 | 970 | 1470 | — | >2000 |

EXAMPLE 5

Mixing of rosin fortified with fumaric acid and distearyl carbamoyl chloride was carried out according to the following: The rosin was melted in an open reactor at a temperature of 150° C. and the carbamoyl chloride was then added under good agitation. The temperature was lowered to room temperature. At the lowering of the temperature the temperature when the viscosity of the mixture was about 1000 cP was recorded.

| Mixture | Parts of rosin degree of fortification 10% | 13.3% | Parts of carbamoyl-chloride | °C. for 1000 cp |
|---|---|---|---|---|
| 5A | 100 | | 0 | 135 |
| 5B | | 100 | 0 | 140 |
| 5C | | 98 | 2 | 100 |
| 5D | 95.2 | | 4.8 | 88 |
| 5E | 95.5 | | 7.5 | 81 |
| 5F | | 92.0 | 8 | 84 |
| 5G | 90 | | 10 | 73 |
| 5H | | 84 | 16 | 72 |

EXAMPLE 6

The mixing process of Example 5 was repeated and hereby a cationic emulsifier, dioctadecyl dimethylammonium chloride was also added to the molten rosin phase. The rosin material had a degree of fortification of 10%. Besides mixtures of carbamoyl chloride, as the synthetic sizing agent, mixtures with dialkylketene dimers were also prepared. The temperature at a viscosity of about 1000 cP was measured and density at room temperature was determined.

Mixture 6A contains only rosin, mixture 6B contains 4.6% of dialkyl carbamoyl chloride and mixtures 6C and 6D contain 4.7% of ketene dimer and mixture 6E contains 9.5% of dialkylcarbamoyl chloride.

| Mixture | Emulsifier % | Density g/cm$^3$ | °C. for 1000 cp |
|---|---|---|---|
| 6A | 4.4 | 1.08 | 120 |
| 6B | 4.2 | 1.05 | 83 |
| 6C | 4.4 | 1.04 | 76 |
| 6D | — | 1.07 | 84 |
| 6E | — | 1.07 | 70 |

EXAMPLE 7

The mixtures 6B and 6C of Example 6 were dispersed and evaluated in the same manner as in Example 3.

| Dosage % | Cobb$_{60}$ g/m$^2$ for dispersion 7B | 7C |
|---|---|---|
| 0.13 | 57 | 65 |
| 0.17 | 32 | 36 |
| 0.23 | 25 | 28 |
| 0.42 | 19 | 21 |

EXAMPLE 8

The mixtures 6D and 6E were dispersed to anionic dispersions according to Example 3 and here 4.9 percent by weight of sodium laurylsulphate was used as the emulsifier. The dispersions were evaluated as in Example 2.

| Dosage % | Cobb$_{60}$ g/m$^2$ for dispersion 6D | 6E |
|---|---|---|
| 0.13 | 68 | 52 |
| 0.16 | 42 | 32 |
| 0.21 | 34 | 26 |

-continued

| Dosage % | Cobb$_{60}$ g/m$^2$ for dispersion 6D | 6E |
|---|---|---|
| 0.31 | 25 | 22 |

EXAMPLE 9

Anionic dispersions were prepared from mixtures of fortified rosin and dialkylcarbamoyl chloride and dialkylketene dimer respectively according to Example 3 using sodium laurylsulphate as the emulsifier. A minor amount of dodecylbenzene sulphonic acid had first been added to the carbamoyl chloride. The compositions of the dispersions are shown in the table below.

| Dispersion | Rosin % | Carbamoyl-chloride | Ketene dimer % | Emulsifier % |
|---|---|---|---|---|
| 9A | 94.5 | 4.7 | | 2.9 |
| 9B | 93.2 | 5.9 | | 3.2 |
| 9C | 89.9 | 8.8 | | 4.7 |
| 9D | 88.5 | 9.8 | | 5.4 |
| 9E | 87.3 | 11.0 | | 6.0 |
| 9F | 95.2 | | 4.8 | 2.6 |
| 9G | 90.4 | | 9.6 | 5.2 |

All the dispersions were evaluated as sizing agents. Laboratory sheets with a basis weight of 140 g/m$^2$ were prepared from bleached sulphate pulp. In all cases the sizing agent was added to 0.4%, calculated as dry on dry fibre weight. Additional retention agent, polyethyleneimine, was added in some cases. In addition to Cobb-values, the resistance of the sheets to penetration of lactic acid was also measured by measuring the edge penetration after 1 hour. This penetration was measured using a so-called "edgewick" absorption test where values after 1 hour of between 0.2 and 0.4 are very good and values between 0.4 and 0.6 are acceptable. The results are shown in the table below.

| Dispersion | Retention agent % | Cobb$_{60}$ g/m$^2$ | Edge penetration g/m |
|---|---|---|---|
| 9A | — | 22.3 | 0.62 |
| 9A | 0.2 | 19.3 | 0.28 |
| 9B | — | 21.2 | 0.48 |
| 9B | 0.2 | 18.2 | 0.23 |
| 9C | — | 20.6 | 0.39 |
| 9C | 0.2 | 17.8 | 0.22 |
| 9D | — | 20.0 | 0.41 |
| 9D | 0.2 | 17.2 | 0.19 |
| 9E | — | 19.4 | 0.37 |
| 9E | 0.2 | 16.9 | 0.18 |
| 9F | — | 23.3 | 0.60 |
| 9F | 0.2 | 18.0 | 0.26 |
| 9G | — | 21.7 | 0.54 |
| 9G | 0.2 | 20.0 | 0.44 |

EXAMPLE 10

In this test the lactic acid resistance, after varying numbers of hours, was determined for sheets prepared with the dispersions 9B and 9E. As a comparison the lactic acid resistance was determined for two other series of sheets which had been sized with only fortified rosin.

| Dispersion | Dosage % | Carbamoyl-chloride | Edge penetration after 1h | 6h | 12h | 24h |
|---|---|---|---|---|---|---|
| 9B | 0.4 | 5.9 | 0.23 | 1.3 | 2.3 | 2.9 |
| 9E | 0.4 | 11.0 | 0.18 | 1.2 | 2.1 | 2.6 |
| 10A | 0.4 | — | 0.44 | 2.3 | 3.2 | 3.6 |
| 10B | 0.7 | — | 0.36 | 2.8 | 4.2 | 4.9 |

EXAMPLE 11

To study the effect of rosin in dialkyl carbamoyl chloride the effect of the dispersion 3E (60% rosin and 40% carbamoyl chloride) was studied at pH 4.5 and pH 8. A comparison was made with a dispersion of solely carbamoyl chloride, dispersion 2H.

| | $Cobb_{60}$ g/m$^2$ | | |
|---|---|---|---|
| | Dispersion 3E | | |
| Dosage % | pH 4.5 2% alum | pH 8.0 without alum | Dispersion 2H pH 8.0 |
| 0.06 | 78 | 82 | 28 |
| 0.08 | 53 | 58 | 22 |
| 0.10 | 30 | 32 | 20 |
| 0.15 | 24 | 22 | 18 |
| 0.20 | 19 | 20 | 17 |

At a pH of 8 no sizing effect of rosin can be obtained without alum. The improvement in cost-efficiency which is obtained with the mixture of rosin and carbamoyl chloride at a pH of 8 can thus be attributed to a better distribution of the carbamoyl chloride on the fibres.

We claim:

1. An aqueous dispersion that contains
(a) water,
(b) at least one dispersing agent selected from the group consisting of anionic and cationic dispersing agents, and
(c) a dispersed phase in the form of a plurality of individual particles, each of said individual particles being composed of a mixture of
(1) 10–96% by weight of a hydrophobing rosin material, and
(2) a synthetic cellulose reactive sizing agent selected from the group consisting of a hydrophobing carbamoyl chloride or a ketene dimer or an acid anhydride.

2. A dispersion according to claim 1 wherein said mixture in (c) contains from 10 to 60 percent by eight of the hydrophobing rosin material.

3. A dispersion according to claim 2 wherein said mixture in (c) contains at least one cationic dispersing agent.

4. A dispersion according to claim 1 wherein said mixture in (c) contains from 80 to 96 percent by weight of said hydrophobing rosin material.

5. A dispersion according to claim 1 wherein said synthetic sizing agent of (c)(2) is carbamoyl chloride.

6. A dispersion according to claim 2 wherein said synthetic sizing agent of (c)(2) is a carbamoyl chloride.

7. A dispersion according to claim 3 wherein said synthetic sizing agent of (c)(2) is a carbamoyl chloride.

8. A dispersion according to claim 4 wherein said synthetic sizing agent of (c)(2) is a carbamoyl chloride.

9. A method for the preparation of an anionic or cationic aqueous dispersion containing particles composed of a homogeneous mixture of hydrophobing rosin and a synthetic sizing agent selected from the group consisting of a hydrophobing carbamoyl chloride or a ketene dimer or an acid anhydride, wherein said particles composed of a homogeneous mixture is prepared by mixing 10 to 95 percent by weight of said hydrophobing rosin material with 4 to 90 percent by weight of said synthetic cellulose reactive sizing agent, whereafter said particles composed of said homogeneous mixture are dispersed in water in the presence of at least one anionic or cationic dispersing agent.

10. A method according to claim 9 wherein said particles of said homogeneous mixture is prepared by combining 80–96% percent by weight of said hydrophobic rosin material with 4 to 20 percent by weight of said synthetic sizing agent.

11. A method according to claim 9 wherein said synthetic sizing agent is carbamoyl chloride.

12. A method according to claim 10 wherein said synthetic sizing agent is carbamoyl chloride.

13. A method of sizing paper, paper board, board and similar cellulose products which comprises applying thereto an aqueous dispersion that contains
(a) water,
(b) at least one dispersing agent selected from the group consisting of anionic and cationic dispersing agents, and
(c) a dispersed phase in the form of a plurality of individual particles, each of said individual particles being composed of a mixture of
(1) 10–96% by weight of a hydrophobing rosin material, and
(2) a synthetic cellulose reactive sizing agent selected from the group consisting of a hydrophobing carbamoyl chloride or a ketene dimer or an acid anhydride.

14. A method according to claim 13 wherein said mixture in (c) contains from 10 to 60 percent by weight of the hydrophobing rosin material.

15. A method according to claim 13 wherein said mixture in (c) contains at least one cationic dispersing agent.

16. A method according to claim 13 wherein said mixture in (c) contains from 80 to 96 percent by weight of said hydrophobing rosin material.

17. A method according to claim 13 wherein said synthetic sizing agent of (c)(2) is a carbamoyl chloride.

18. A method according to claim 1 wherein said individual particles also contain not more than 15 percent by weight of a non-hydrophobing agent.

19. A method according to claim 1 wherein said individual particles also contain not more than 15 percent by weight of a non-hydrophobing agent.

20. A dispersion according to claim 1 wherein said synthetic sizing agent of (c)(2) is a ketine dimer.

21. A dispersion according to claim 2 wherein said synthetic sizing agent of (c)(2) is a ketene dimer.

22. A dispersion according to claim 3 wherein synthetic sizing agent of (c)(2) is a ketene dimer.

23. A dispersion according to claim 4 wherein said synthetic sizing agent of (c)(2) is a ketene dimer.

24. A dispersion according to claim 1 wherein said hydrophobing rosin material has an acid number of about 200 or higher.

25. A method according to claim 9 wherein said hydrophobing rosin material has an acid number of about 200 or higher.

26. A method according to claim 13 wherein said hydrophobing rosin material has an acid number of about 200 or higher.

* * * * *